United States Patent [19]

Chambers et al.

[11] 4,285,285

[45] Aug. 25, 1981

[54] FEED DEVICE AND METHOD FOR FEEDING YARN OR OTHER TEXTILE MATERIAL

[75] Inventors: George Chambers; Kenneth F. Hall, both of Martock, England

[73] Assignee: Newroyd Limited, Lancashire, England

[21] Appl. No.: 89,726

[22] Filed: Oct. 31, 1979

[30] Foreign Application Priority Data

Nov. 10, 1978 [GB] United Kingdom ..... 44044/78

[51] Int. Cl.[3] ..... D05C 15/00

[52] U.S. Cl. ..... 112/79 FF; 139/452; 66/123

[58] Field of Search ..... 112/79 FF, 79 R, 270, 112/79 A; 242/147 A; 226/95, 97; 66/7, 123; 139/452

[56] References Cited

U.S. PATENT DOCUMENTS

| | | | |
|---|---|---|---|
| 3,580,444 | 5/1971 | Van Mullekom | 226/97 |
| 3,750,716 | 8/1973 | Kimura et al. | 139/452 |
| 4,090,536 | 5/1978 | Van Mullekom | 139/452 |

FOREIGN PATENT DOCUMENTS

| | | | |
|---|---|---|---|
| 2444973 | 4/1975 | Fed. Rep. of Germany | 242/147 A |
| 2657037 | 2/1978 | Fed. Rep. of Germany | 139/452 |
| 1396637 | 4/1963 | France | 112/79 FF |
| 1527652 | 10/1978 | United Kingdom . | |

*Primary Examiner*—Ronald Feldbaum
*Attorney, Agent, or Firm*—Anthony J. Casella

[57] ABSTRACT

A feed device for feeding yarn or other textile material, the device comprising a hollow member through the interior of which textile material may be passed, feed means for feeding the textile material to the said interior, reciprocating means for reciprocating the hollow member towards and away from the feed means, fluid jet means for directing at least one fluid jet onto the textile material being fed to the hollow member so as to tension the said textile material, and pressure supply means which are arranged to supply a pressure fluid to the said interior to entrain the textile material therethrough during a predetermined portion only of the reciprocation of the hollow member, the pressure supply means also supplying the fluid jet means with an intermittently varying fluid pressure which is respectively reduced and increased, so as to reduce and increase the said tension, in accordance with whether or not the textile material is being entrained through the said interior.

12 Claims, 5 Drawing Figures

FEED DEVICE AND METHOD FOR FEEDING YARN OR OTHER TEXTILE MATERIAL

Figure 1:
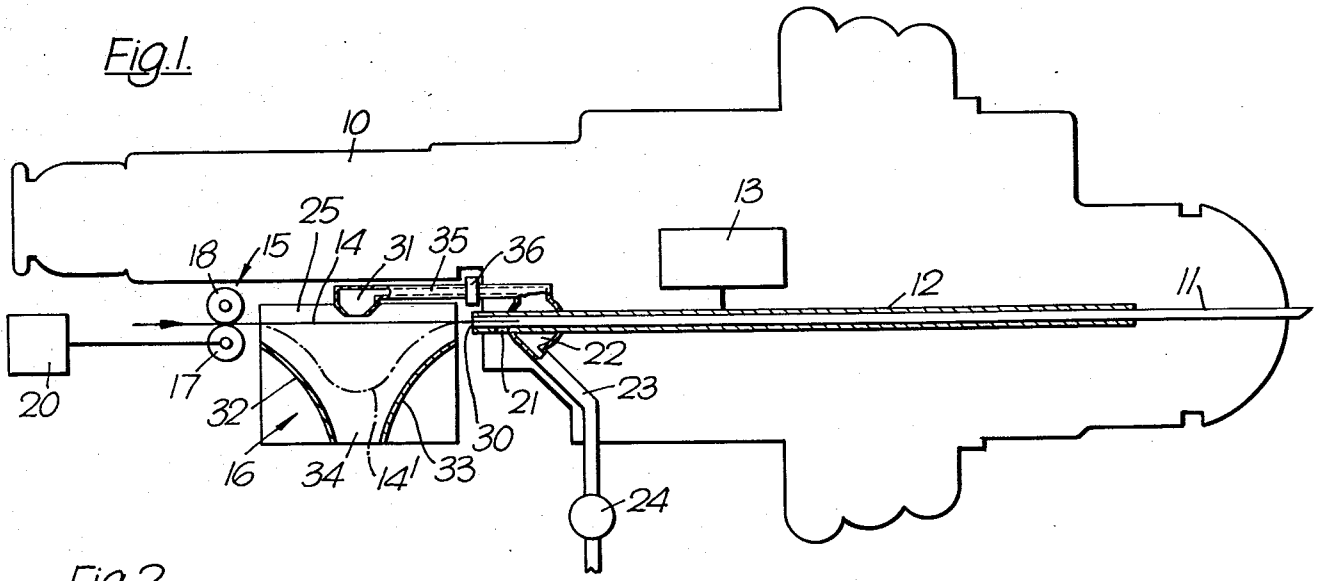

This invention concerns a feed device and a method for feeding yarn or other textile material and, although the invention is not so restricted, it is more particularly concerned with a feed device and method for feeding a length of yarn or continuous filament to a needle of a textile machine such, for example, as a tufting machine.

In our British Pat. No. 1,527,652, we have disclosed a tufting machine which comprises a reciprocated hollow needle to the interior of which yarn is delivered by means of yarn feed rollers whose operation is controlled by a servo motor. The servo motor ensures that the required length of yarn is delivered to the hollow needle for each needle cycle and that this length of yarn is the length required to form tufts of a predetermined pile height in textile backing material.

The needle is reciprocated into and out of the textile backing material and a flow of air is passed through the interior of the needle, whenever the needle has penetrated the backing material, so as to entrain the yarn through the needle. When however the needle is withdrawn from the backing material, it is necessary to stop the flow of air so as to prevent the yarn being fed from the leading end of the needle at this time. Consequently the feeding of the yarn through the interior of the hollow needle is intermittent in accordance with the needle cycle, while the delivery of the yarn by the yarn feed rollers may be continuous. In each feed cycle, therefore, surplus yarn is built up between the yarn feed rollers and the hollow needle, and the existence of this surplus yarn causes a variation in the yarn tension during the needle cycle.

If the rate at which the needle reciprocates is constant and there is a constant yarn delivery rate to the needle, this surplus yarn will normally oscillate in a stable manner and consistent tuft formation can be achieved. If, however, the yarn oscillation becomes unstable for any reason, irregular variations in the yarn tension occur and these variations are out-of-phase with the needle cycle and thus result in irregular tuft formation. When such irregular variations in the yarn tension arise, the air which is passed through the interior of the needle may not carry forward all the yarn delivered by the yarn feed rollers during a particular feed cycle, and if this occurs the undelivered length of yarn is added to the yarn being delivered to the needle for the next feed cycle with the result that a short tuft is followed by a long tuft, and the fault can affect more than one needle cycle.

In practice, in any case, it is not possible to maintain a constant rate of needle reciprocation when starting and stopping the tufting machine since the needle is being respectively accelerated and decelerated at these times. Similarly, it is not possible to maintain a constant yarn delivery rate since the rate of needle reciprocation is arranged to control the yarn delivery rate. Furthermore, the machine can be programmed for changes in tuft length, i.e. changes in the yarn length delivered per needle cycle, it can be programmed for changes in tuft interval, and it can be programmed so that the needle is reciprocated at fast and slow speeds. Thus there is inevitably at times a change in the length of surplus yarn and a consequent variation in the tension of the yarn.

According therefore to the present invention there is provided a feed device for feeding yarn or other textile material, the device comprising a hollow member through the interior of which textile material may be passed, feed means for feeding the textile material to the said interior, reciprocating means for reciprocating the hollow member towards and away from the feed means, fluid jet means for directing at least one fluid jet onto the textile material being fed to the hollow member so as to tension the said textile material, and pressure supply means which are arranged to supply a pressure fluid to the said interior to entrain the textile material therethrough during a predetermined portion only of the reciprocation of the hollow member, the pressure supply means also supplying the fluid jet means with an intermittently varying fluid pressure which is respectively reduced and increased, so as to reduce and increase the said tension, in accordance with whether or not the textile material is being entrained through the said interior.

Preferably the pressure supply means comprises a pressure chamber, cut off means for periodically and cutting off communication between the pressure chamber and the said interior, and conduit means interconnecting the pressure chamber and the fluid jet means.

The said cut-off means may be movable between two positions in one of which pressure fluid is supplied only to the said interior and in the other of which pressure fluid is supplied only to the said conduit means. Alternatively, and preferably, the conduit means is in permanent communication with the pressure chamber, the pressure in the pressure chamber and hence in the conduit means varying in accordance with whether the pressure chamber is in communication with the said interior.

There may be a restrictor in the conduit means.

There may also be a regulator for adjusting the maximum fluid pressure supplied to the hollow member and to the fluid jet means.

The hollow member may have at least one aperture in its wall, the reciprocating means reciprocating the hollow member into and out of a position in which the aperture or apertures communicate with the said pressure chamber.

The hollow member is preferably a hollow needle or a hollow needle carrier shaft.

The feed means may, in operation, be continuously operative.

The feed means preferably comprises unenclosed rollers between the nip of which the material may pass.

The device may comprise a housing having a passage through which the textile material may pass on its way to the hollow member, the fluid jet means being arranged to direct at least one fluid jet onto the textile material passing through said passage the feed means being arranged to feed the textile material to the passage and being controlled by control means which operate independently of the fluid supply means which entrain the textile material intermittently through the said interior, so that at times there is surplus material in the said passage.

The feed means, the passage and the hollow member may be aligned so that the material may pass therebetween in a substantially straight line path.

The housing may comprise two spaced apart parallel plates between which the textile material may pass, the fluid jet means being arranged to direct at least one fluid jet onto the textile material from one side thereof, and there being guide means on the other side thereof for directing the fluid from the fluid jet means through an exit orifice in the housing.

The invention also comprises a method of feeding yarn or other textile material comprising feeding the textile material to the interior of a reciprocating hollow member, directing at least one fluid jet onto the textile material being fed to the hollow member so as to tension the said textile material, and supplying to the said interior a pressure fluid which entrains the textile material therethrough during a predetermined portion only of the reciprocation of the hollow member, the said fluid jet or jets having an intermittently varying fluid pressure which is respectively reduced and increased, so as to reduce and increase the said tension, in accordance with whether or not the textile material is being entrained through the said interior.

The hollow member is preferably a hollow needle which is reciprocated into and out of backing material, pressure fluid being prevented from passing through the interior of the hollow needle when the latter has been withdrawn from the backing material.

Figure 2:
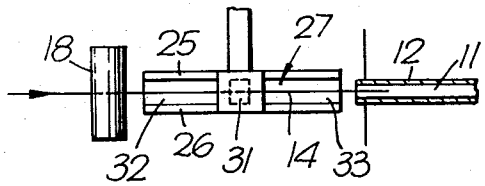
Figure 3:
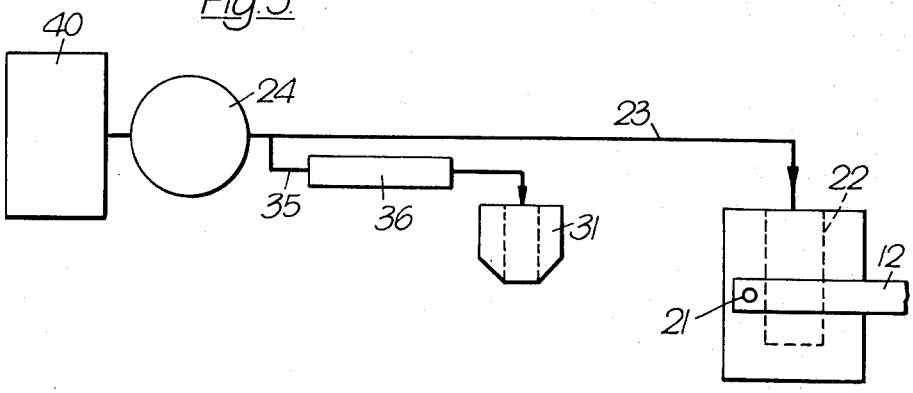
Figure 5:
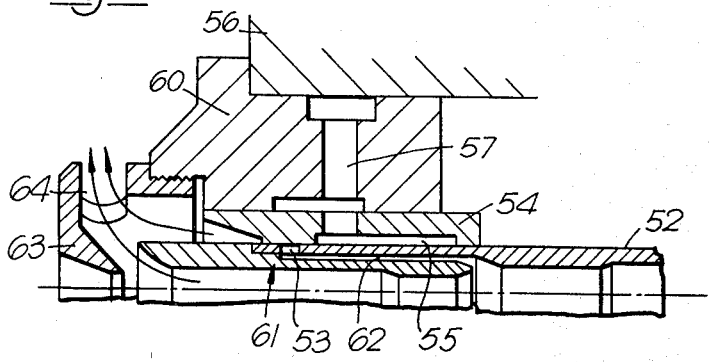
Figure 4:
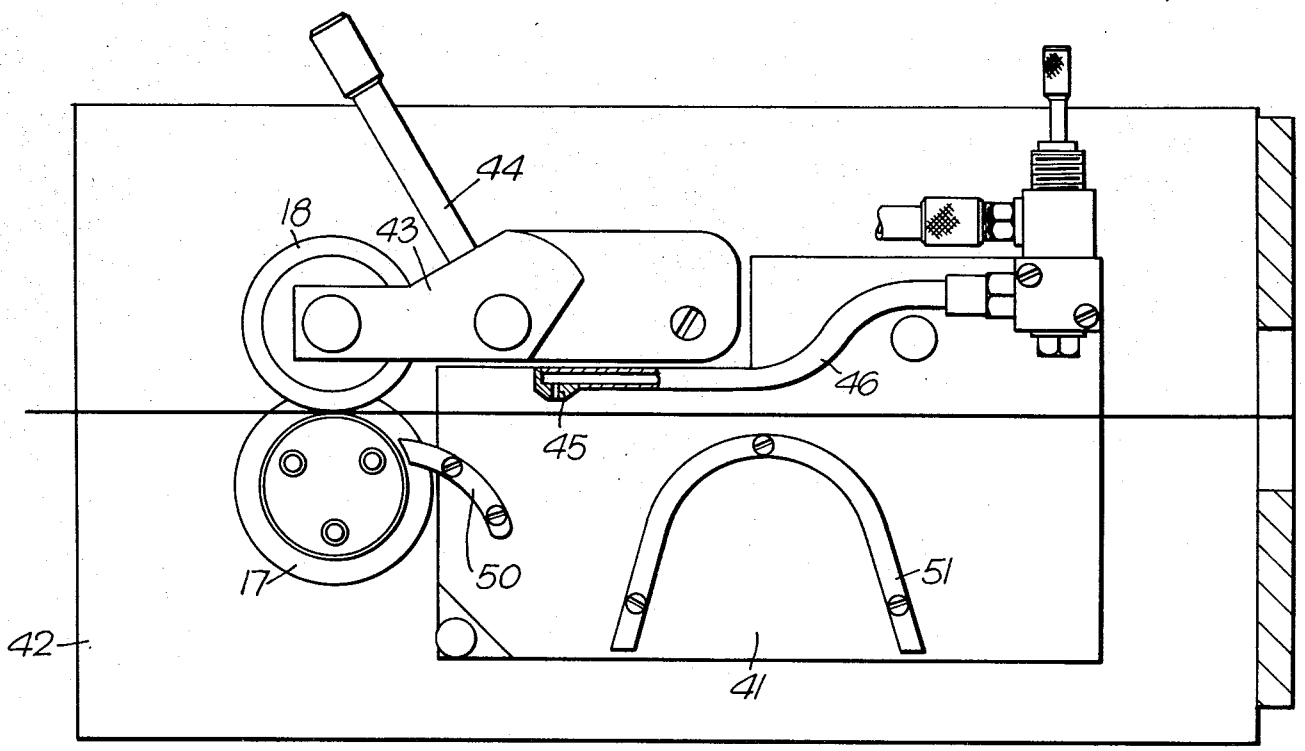

The invention is illustrated, merely by way of example, in the accompanying drawings, in which:

FIG. 1 is a diagrammatic elevation of a tufting machine provided with an embodiment of a feed device according to the present invention, FIG. 2 is a diagrammatic plan view of the feed device of FIG. 1, FIG. 3 diagrammatically illustrates another embodiment of the feed device, and FIGS. 4 and 5 are sections illustrating parts of further embodiments of the feed device.

Referring first to FIGS. 1 and 2 of the drawings, a tufting machine 10 is provided with a feed device comprising a hollow tufting needle 11 which is mounted in a hollow needle carrier shaft 12.

The needle carrier shaft 12 is reciprocated by a control means which is shown diagrammatically at 13 and which is explained in detail in our British Pat. No. 1,527,652, the control means 13 being controlled in accordance with a predetermined programme so as to reciprocate the needle 11 into and out of textile backing material (not shown).

Yarn 14 (or other textile material such as a continuous filament) is fed in a straight line path from a yarn feed means 15 to the hollow interior of the needle carrier shaft 12 by way of a passage through a housing 16, the control means 13 reciprocating the needle carrier shaft 12 towards and away from the yarn feed means 15.

The yarn feed means 15 comprises a driven yarn feed roller 17 and a pressure roller 18 between the nip of which passes the yarn 14, both the rollers 17, 18 being unenclosed. As explained in our said British. Patent, the yarn feed roller 17 is controlled by a servo motor 20 which ensures that the required length of yarn is in operation continuously delivered to the needle 11 for each needle reciprocation cycle, the length of yarn being that necessary to form tufts of a predetermined pile height.

The needle carrier shaft 12 has at least one aperture 21 in its wall. When the needle 11 has been withdrawn from the textile backing material and is in the position at one end of its reciprocation which is shown in FIG. 1, the aperture 21 is out of communication with a pressure chamber 22 which receives compresed air or other fluid from a reservoir thereof (not shown) by way of a conduit 23. When, however, the needle carrier shaft 12 is reciprocated towards the right as shown in FIG. 1, so as to introduce the needle 11 into the textile backing material, the aperture 21 is brought into communication with the pressure chamber 22, whereby a flow of compressed air passes through the interior of the needle carrier shaft 12 end needle 11 so as to entrain the yarn 14 therethrough.

The conduit 23 has a regulator 24 connected therein for adjusting the fluid pressure in the pressure chamber 22 and thus for adjusting the maximum fluid pressure both supplied to the interior of the needle carrier shaft 12 and to the fluid pressure means for tensioning the yarn which are described below. This adjustment in the fluid pressure is necessary to cater for differences in the sizes of the yarn 14 of the needle 11 employed.

As will be appreciated from the above description, the control device 13 is in operation intermittently operative in accordance with the predetermined cycle, whereas the feed delivery rollers 17, 18 are continuously operative. Moreover, the latter are controlled by the servo motor 20 which operates independently of parts 13, 21, 22 which collectively ensure that the yarn 14 is entrained intermittently through the needle carrier shaft 12. As a result, at times there is surplus material in the passage through the housing 16.

The housing 16 comprises two spaced apart parallel plates 25, 26 which are open along their upper and lower horizontal sides, the space 27 being the plates 25, 26 forming the said passage through which passes the yarn 14 in the straight line path from the delivery rollers 17, 18 to an entry orifice 30 of the needle carrier shaft 12.

The plates 25, 26 are separated from each other by a distance at least as great as the diameter of the yarn 14.

Mounted above the upper sides of the plates 25, 26 and thus above the yarn 14 is at least one compressed air jet 31, while mounted below the yarn 14 are guides 32, 33 for directing the compressed air from the air jet 31 out through an exit orifice 34 in the housing 16, the thickness of each of the guides 32, 33 being equal to the spacing between the plates 25, 26.

The air jet 31 has an orifice which is preferably rectangular and which is adapted to direct a jet of compressed air at right angles to the path of the yarn 14 passing through the passage 27.

The length of the housing 16 between the rollers 17, 18 and the entry orifice 30, the number and longitudinal spacing of the air jets 31, and the air pressure employed at the air jets 31 can all be varied to suit the yarn characteristics and the lenth of yarn to be accommodated in the housing 16.

The air supplied to the air jet 31 is derived from the pressure chamber 22 by way of a conduit 35 containing a restrictor 36, with the result that the pressure of the air supplied to the air jet 31 is increased whenever the air flow through the needle 11 is cut off, although in operation air is continuously supplied to the air jet 31.

In operation, when the control means 13 withdraws the needle 11 behind the textile backing material, the aperture 21 is cut off from the pressure chamber 22 and compressed air is therefore not supplied to the interior of the needle carrier shaft 12, whereby to ensure that the yarn is not fed outwardly of the needle 11 at this time. Since compressed air is not supplied to the interior of the needle carrier shaft 12, the pressure in the pressure chamber 22 and hence at the air jet 31 rises so that the pressure is sufficient to blow the yarn 14 to a position indicated at 14', whereby to take up the slack in the yarn. When, however, the control means 13 causes the needle 11 to move forwardly into the backing material, the aperture 21 is bought into communication with the pressure chamber 22 and compressed air is therefore supplied to the interior of the needle carrier shaft 12 to entrain the yarn therethrough. The pressure in the pressure chamber 22 therefore drops, whereby to reduce the pressure at the air jet 31 to a value such that the tensioning of the yarn 14 which is effected thereby is not sufficient to restrict the forward movement of the yarn 14 to the needle 11.

The compressed air is thus intermittently supplied to the interior of the needle carrier shaft 12 and there is an intermittently varying air pressure supply to the air jet 31 which is respectively reduced and increased, so as to reduce and increase the tension in the yarn, in accordance with whether or not the yarn is being entrained through the said interior. The yarn 14 is thus tensioned at all times, but is tensioned most when there is the most slack in the yarn.

In FIG. 3 there is shown diagrammatically another embodiment of the feed device of the present invention. The feed device of FIG. 3 is generally similar to that of FIGS. 1 and 2 and for this reason will not be described in detail, like reference numerals indicating like parts.

In the FIG. 3 construction, however, a pressure source or chamber 40 supplies compressed air to the pressure chamber 22 by way of the regulator 24 and conduit 23, while the air jet 31, instead of communicating with the pressure chamber 22 communicates via the conduit 35 and the restrictor 36 with the regulator 24 so as to receive a compressed air supply directly from the pressure source or chamber 40. As shown in FIG. 4, the housing 16 of FIG. 1 may be replaced by a housing 41 which is mounted on a rear frame portion 42 of the tufting machine 10, the rollers 17, 18 being carried by the rear frame portion 42. The pressure roller 18 is mounted on an arm 43 which is pivotable by a handle 44 towards and away from the feed roller 17. Mounted on the rear frame portion 42 is an air jet having a nozzle member 45 which is supplied with compressed air through a pipe 46. The guides 32, 33 of FIG. 1 are replaced by a curved guide 50 and an inverted U-shaped guide 51, the nozzle member 45 being arranged to direct the air jet between the guides 50, 51.

In FIG. 5 there is shown a modification in which the needle carrier shaft 12 is replaced by a needle carrier shaft 52 having eight equi-angularly spaced apart apertures 53 (only one shown). The needle carrier shaft 52 is mounted radially inwardly of and is reciprocable axially of a fixed cut-off bush 54. The bush 54 has a recess 55, therein which is arranged to receive compressed air from a pressure chamber 56 via a passage 57 in a housing 60. A yarn inlet bush 62 is screwed into the rear end of the needle carrier shaft 52 and defines with the latter an annular passage 62 through which the compressed air passes to the interior of the needle carrier shaft 52. An air deflector 63, which is carried by the housing 60, has an aperture 64 through which air from the interior of the needle carrier shaft 52 may escape when the latter is out of communication with the recess 55.

The efficiency of the feed device shown in the drawings is not affected by variations in the length of yarn delivered per needle cycle and can easily be modified to cater for a wide range of yarn diameters. It provides a method of controlling the yarn tension without mechanically moving components.

A computer controlled single needle tufting machine such as is described in our British Pat. No. 1,527,652, can operate at much higher needle reciprocation rates than conventional tufting machines, and this means that the yarn is delivered to the needle at correspondingly higher speeds. Such a computer controlled machine, moreover, can allow three-dimensional pattern effects to be achieved by programmed changes in pile height, such changes being effected by changes in the yarn delivery rate between consecutive needle cycles. This combination of high speed and changes in yarn delivery rate in such a computer controlled single needle tufting machine requires means for accommodating surplus yarn with a swift response rate, and this is provided by the device shown in the drawings. Without such a device, the needle reciprocation rate, which determines the machine production would have to be reduced.

Although the invention has been described with reference to the use of the feed device on a single needle tufting machine, the device may also be used on multi-needle tufting machines and on other textile machines which have tension differences during a stitch-forming cycle.

We claim:

1. A tufting machine comprising a hollow member through the interior of which textile material may be passed; a housing having a passage through which the textile material may pass on its way to the said interior; cooperating rollers between the nip of which the textile material may be passed, for feeding the textile material to the passage, the cooperating rollers, the passage and the hollow member being aligned to ensure that the textile material passes therebetween in a substantially straight line path; reciprocating means for reciprocating the hollow member towards and away from the cooperating rollers; fluid jet means for directing at least one fluid jet onto the textile material passing through the passage so as to tension the said textile material; and pressure supply means which are arranged to supply a pressure fluid to the said interior to entrain the textile material therethrough during a predetermined portion only of the reciprocation of the hollow member, the pressure supply means also supplying the fluid jet means with an intermittently varying fluid pressure which is respectively reduced and increased, so as to reduce and increase the said tension, in accordance with whether or not the textile material is being entrained through the said interior.

2. A machine as claimed in claim 1 in which the pressure supply means comprises a pressure chamber, cut off means for periodically establishing and cutting off communication between the pressure chamber and the said interior, and conduit means interconnecting the pressure chamber and the fluid jet means.

3. A machine as claimed in claim 2 in which the cut-off means are movable between two positions in one of which pressure fluid is supplied only to the said interior and in the other of which pressure fluid is supplied only to the said conduit means.

4. A machine as claimed in claim 2 in which the conduit means is in permanent communication with the pressure chamber, the pressure in the pressure chamber and hence in the conduit means varying in accordance with whether the pressure chamber is in communication with the said interior.

5. A machine as claimed in claim 2 in which there is a restrictor in the conduit means.

6. A machine as claimed in claim 2 comprising a regulator for adjusting the maximum fluid pressure supplied to the hollow member and to the fluid jet means.

7. A machine as claimed in claim 2 in which the hollow member has at least one aperture in its wall, the reciprocating means reciprocating the hollow member into and out of a position in which the aperture or apertures communicate with the said pressure chamber.

8. A machine as claimed in claim 6 in which the hollow member is a hollow needle or a hollow needle carrier shaft.

9. A machine as claimed in claim 1 in which, in operation, the cooperating rollers are continuously operative.

10. A machine as claimed in claim 1 in which the housing comprises two spaced apart parallel plates between which the textile material may pass, the fluid jet means being arranged to direct at least one fluid jet onto the textile material from one side thereof, and there being guide means on the other side thereof for directing the fluid from the fluid jet means through an exit orifice in the housing.

11. A machine as claimed in claim 1 in which the cooperating rollers are unenclosed rollers.

12. A machine as claimed in claim 1 in which the cooperating rollers are controlled by control means which operate independently of the pressure supply means which entrain the textile material intermittently through the said interior, so that at times there is surplus material in the said passage.

* * * * *